US012134021B2

(12) United States Patent
Chen et al.

(10) Patent No.: US 12,134,021 B2
(45) Date of Patent: Nov. 5, 2024

(54) STRIKING PRACTICE DEVICE

(71) Applicants: Jusder Enterprise Co., Ltd., Changhua (TW); Chun-An Lin, Taichung (TW)

(72) Inventors: Ming-Hsiung Chen, Changhua (TW); Chun-An Lin, Taichung (TW)

(73) Assignees: Jusder Enterprise Co., Ltd., Changhua (TW); Chun-An Lin, Taichung (TW)

( * ) Notice: Subject to any disclaimer, the term of this patent is extended or adjusted under 35 U.S.C. 154(b) by 172 days.

(21) Appl. No.: 17/903,144

(22) Filed: Sep. 6, 2022

(65) Prior Publication Data

US 2024/0075370 A1 Mar. 7, 2024

(51) Int. Cl.
*A63B 69/22* (2006.01)

(52) U.S. Cl.
CPC ..... *A63B 69/22* (2022.08)

(58) Field of Classification Search
CPC ..... A63B 69/20; A63B 69/215; A63B 69/22; A63B 69/222; A63B 69/224; A63B 69/24; A63B 69/244; A63B 69/26; A63B 69/28; A63B 69/30
See application file for complete search history.

(56) References Cited

U.S. PATENT DOCUMENTS 1,890,696 A * 12/1932 Rosenhahn ..... A63B 69/224 482/90
2,085,161 A * 6/1937 Kraus ..... A63B 69/224 482/90
2,197,545 A * 4/1940 Bachman ..... A63B 69/34 482/85
3,022,072 A * 2/1962 Zinnow ..... A63B 69/224 446/490
5,330,403 A * 7/1994 Kuo ..... A63B 69/224 482/90
6,390,958 B1 * 5/2002 Chu ..... A63B 69/22 482/90
6,464,621 B1 * 10/2002 Chen ..... A63B 69/224 482/90
6,893,384 B2 * 5/2005 Triani ..... A63B 69/224 482/90
7,485,075 B2 * 2/2009 Ghim ..... A63B 69/322 482/84
7,651,447 B2 * 1/2010 Yang ..... A63B 69/224 482/85
7,704,194 B1 * 4/2010 Chen ..... A63B 69/224 482/90

(Continued)

*Primary Examiner* — Joshua Lee
(74) *Attorney, Agent, or Firm* — Demian K. Jackson; Jackson IPG PLLC

(57) ABSTRACT

A striking practice device includes a striking body, a cover, a connecting rod and an outer fixing plate. The striking body includes a hollow portion inside, an assembly hole formed along a direction of the striking body and a cover bole formed along another direction of the striking body. The assembly hole has an inner junction at the hollow portion of the striking body and an outer junction outside the striking body; the cover has a shape corresponding to the cover hole for sealing the cover hole; the connecting rod is installed to the assembly hole and has an inner fixing plate at an end; the inner fixing plate is greater than the assembly hole and disposed at the inner junction; and the outer fixing plate is fixed to the connecting rod and the outer junction of the striking body.

3 Claims, 5 Drawing Sheets

(56) References Cited

U.S. PATENT DOCUMENTS

| | | | | |
|---|---|---|---|---|
| 7,867,148 | B2 * | 1/2011 | Tsakiris | A63B 69/305<br>482/83 |
| 8,641,583 | B2 * | 2/2014 | Chen | A63B 69/224<br>482/90 |
| 10,065,098 | B2 * | 9/2018 | Almeras | A63B 69/305 |
| 10,207,169 | B2 * | 2/2019 | Siklosi | F16B 2/08 |
| 10,258,856 | B2 * | 4/2019 | Conley | A63B 69/22 |
| 10,918,928 | B2 * | 2/2021 | Almeras | A63B 69/305 |
| 11,745,073 | B2 * | 9/2023 | Chen | A63B 69/224<br>482/90 |

* cited by examiner

STRIKING PRACTICE DEVICE

BACKGROUND OF THE INVENTION

Field of the Invention

The present invention relates to a practice device, and more particularly to a striking practice device.

Description of the Prior Art

In order to facilitate people to practice martial arts, kicking and boxing and related sports, some manufacturers have developed a striking practice device that is installed on the ground. With reference to FIG. 5 for conventional striking practice device, the striking practice device includes: a striking body 91 which is a solid foam ball; a connecting rod 92 fixed to the bottom of the striking body 91, and an end of the connecting rod 92 is disposed in the striking body 91 and the other end of the connecting rod 92 is protruded to the outside from the striking body 91, such that the connecting rod 92 and the striking body 91 are combined and fixed.

However, the conventional striking practice device includes the striking body 91 which is a solid foam ball, and thus it is not just easy to crack the striking body 91, but also has the disadvantages of poor durability, short service life, low elasticity and high manufacturing cost.

SUMMARY OF THE INVENTION

Therefore, this disclosure provides a striking practice device, including: a striking body with a hollow portion inside and a striking thickness outside, and the striking body having an assembly hole formed along a direction and a cover hole formed along another direction, the assembly hole at the hollow portion of the striking body having an inner junction, and the assembly hole outside the striking body having an outer junction, and a clamping thickness being defined between the inner junction and the outer junction, and the clamping thickness being greater than the striking thickness, and the cover hole having an inner fitting portion disposed at the position of the striking thickness; a cover, configured with a shape corresponding to the shape of the cover hole, and having an outer fitting portion disposed at the outer periphery thereof and configured to be corresponsive to the outer fitting portion, for sealing the cover hole; a connecting rod, passed and installed into the assembly hole, and having an inner fixing plate disposed at an end thereof, and the inner fixing plate being greater than the assembly hole and installed at the inner junction; and an outer fixing plate, fixed to the connecting rod, and the outer junction, the inner fixing plate and the outer fixing plate of the striking body for clamping and fixing the clamping thickness.

This disclosure is characterized in that the striking body is in a hollow shape and has the striking thickness, and thus it does not just have good structural strength and durability only, but also has the advantages of long service life, good elastic delimitation capacity, and low manufacturing cost.

DESCRIPTION OF THE PREFERRED EMBODIMENTS

The present invention will be clearer from the following description when viewed together with the accompanying drawings, which show, for purpose of illustrations only, a preferred embodiment in accordance with the present invention.

Figure 1:
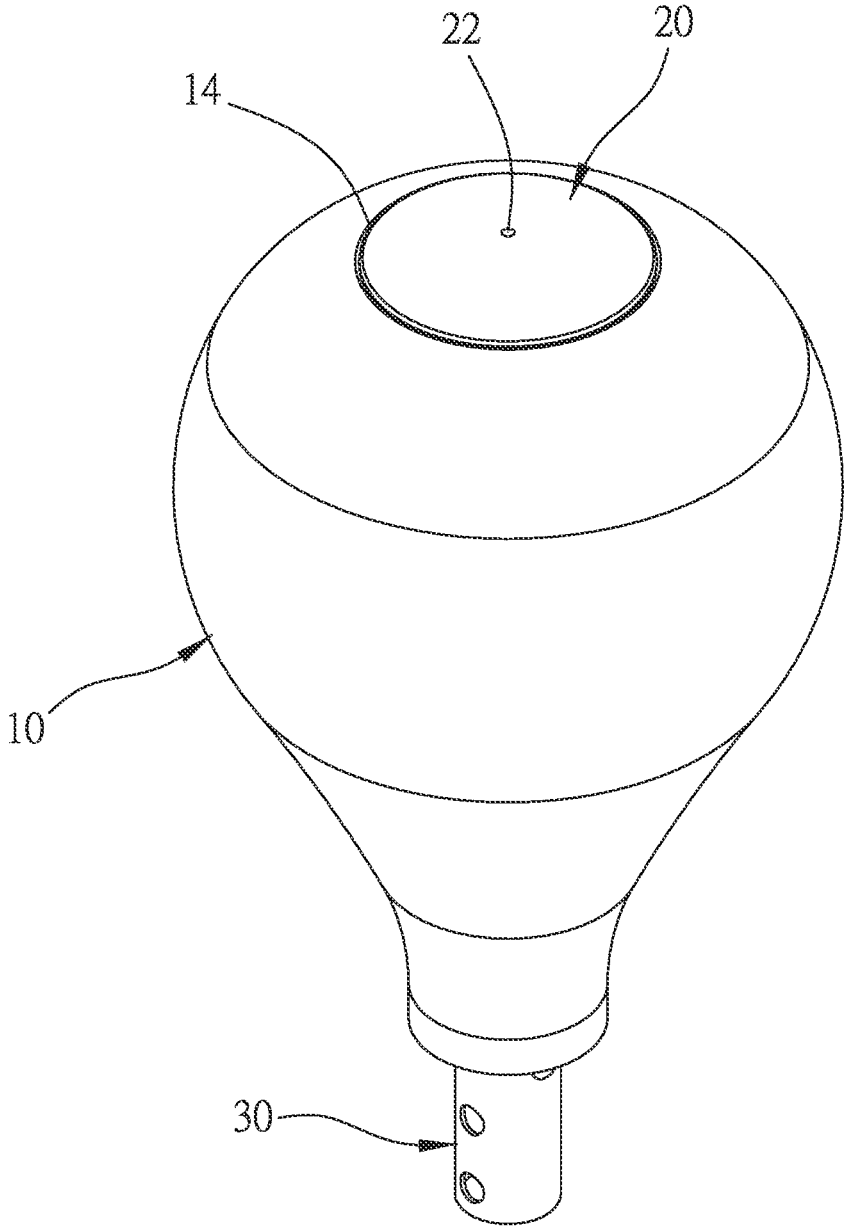
FIG. 1 is a perspective view of this disclosure.
Figure 2:
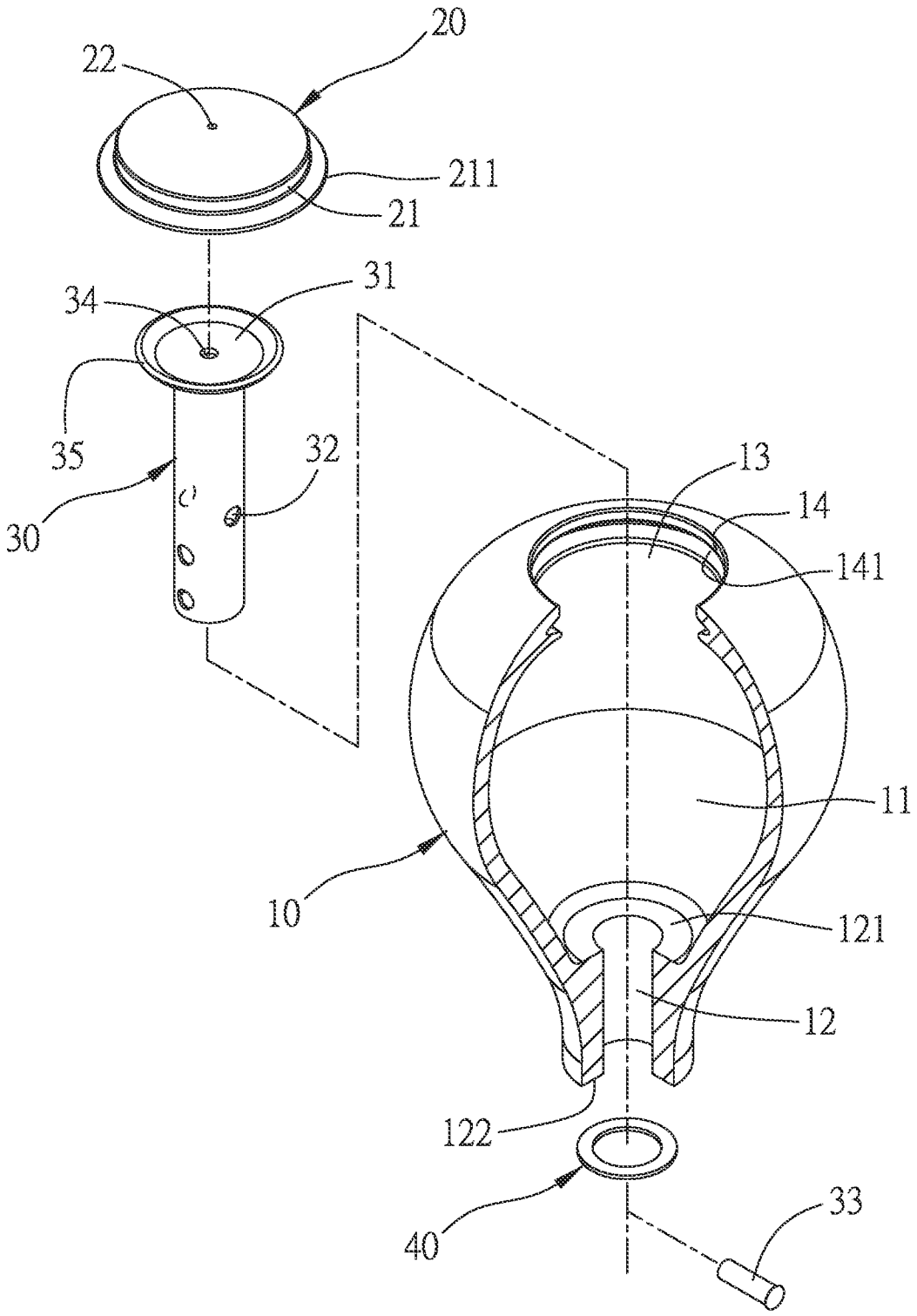
FIG. 2 is an exploded view of this disclosure.
Figure 3:
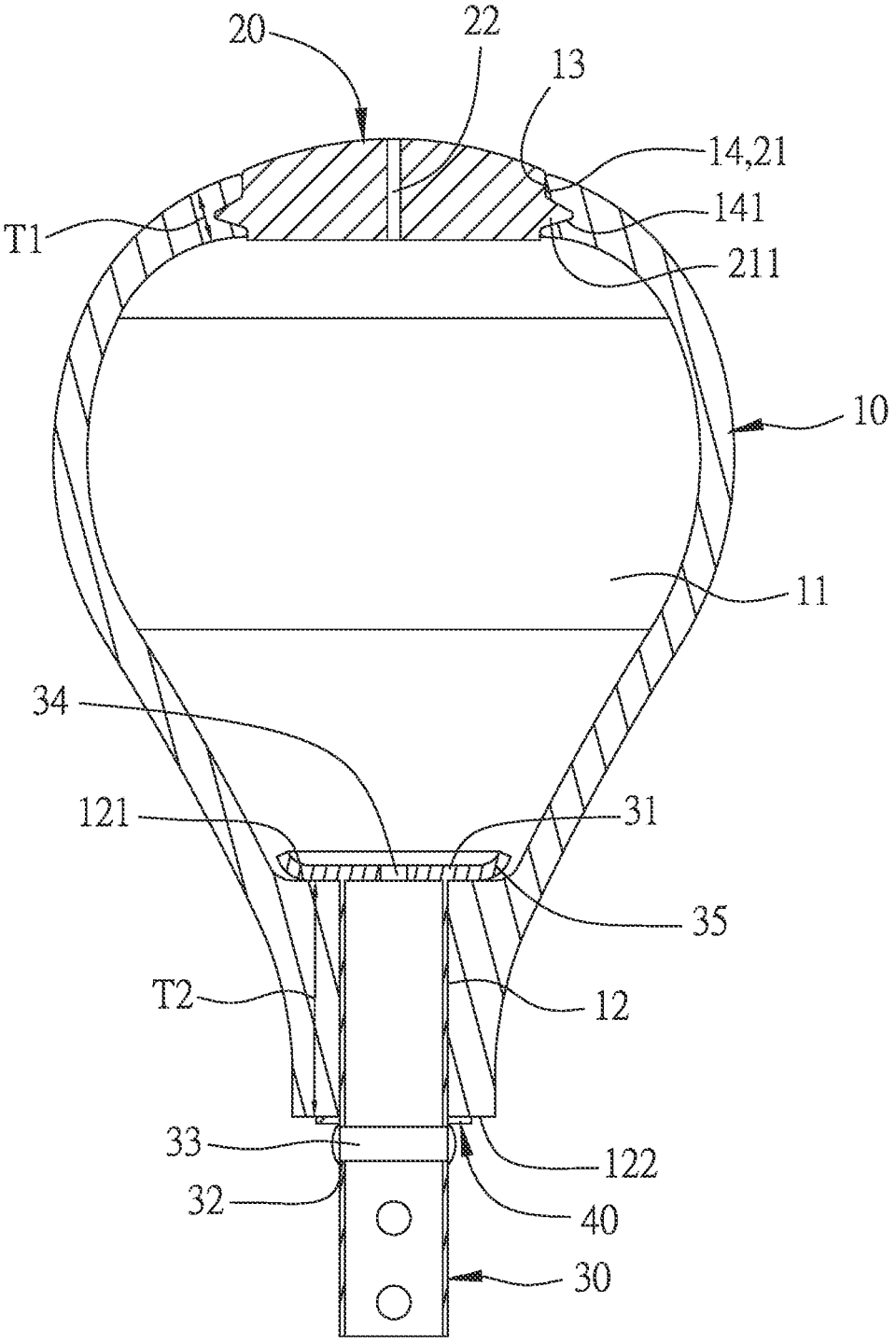
FIG. 3 is a cross-sectional view of this disclosure.

With reference to FIGS. 1 to 3 for a striking practice device of this disclosure, the striking practice device includes: a striking body 10, a cover 20, a connecting rod 30 and an outer fixing plate 40.

The striking body 10 includes a hollow portion 11 inside, and a striking thickness T1 outside. The striking body 10 includes an assembly hole 12 on a side and a cover hole 13 on the other side. The assembly hole 12 has an inner junction 121 at the hollow portion 11 of the striking body 10, an outer junction 122 outside the striking body 10, and the inner junction 121 has a surface area in a circular shape, and the outer junction 122 also has a surface in a circular shape, and a clamping thickness T2 is defined between the inner junction 121 and the outer junction 122, wherein the clamping thickness 12 is greater than the striking thickness T1. The cover hole 13 has an inner fitting portion 14 at the position of the striking thickness T1, and the inner fitting portion 14 has a recession 141. A larger side of the striking body 10 is provided for forming the cover hole 13, and another smaller side of the striking body 10 is provided for forming the assembly hole 12, and the cover hole 13 and the assembly hole 12 are in opposite directions, and the surface area of the inner junction 121 is greater than the surface area of the outer junction 122, and the cross-sectional area of the cover hole 13 is greater than the cross-sectional area of the assembly hole 12.

The cover 20 has a shape corresponding to the cover hole 13 and has an outer fitting portion 21 at the outer periphery of the cover 20, and the outer fitting portion 21 is matched with the inner fitting portion 14 for sealing the cover hole 13, and the outer fitting portion 21 has a protrusion 211, and the protrusion 211 is fitted into the recession 141 of the inner fitting portion 14 of the striking body 10 to increase the combined area, and an adhesive is applied between the outer fitting portion 21 and the inner fitting portion 14 to improve the bonding strength.

The connecting rod 30 is passed and installed to the assembly hole 12 of the striking body 10, and the connecting rod 30 has an inner fixing plate 31 at an end, and the inner fixing plate is greater than the assembly hole 12 and engaged with the inner junction 12:1, and the connecting rod 30 has a horizontal through hole 32 matched with a horizontal fixing part 33, wherein the fixing part 33 is a nut, rivet, or pin, etc., and the connecting rod 30 is in a hollow tubular shape, and has a second air hole 34 communicated with the hollow portion 11 of the striking body 10, and the outer peripheral edge of the inner fixing plate 31 defines an arc-shaped surface 35, the arc-shaped surface 35 contacts the inner junction 121, so as to avoid stress concentration causing the service life of the striking body 10 to decrease.

The outer fixing plate 40 is fixed to the connecting rod 30 by the through hole 32 and the fixing part 33, and engaged with the outer junction 122 of the striking body 10, and the inner fixing plate 31 and the outer fixing plate 40 are provided for clamping and fixing the clamping thickness T2.

Figure 4:
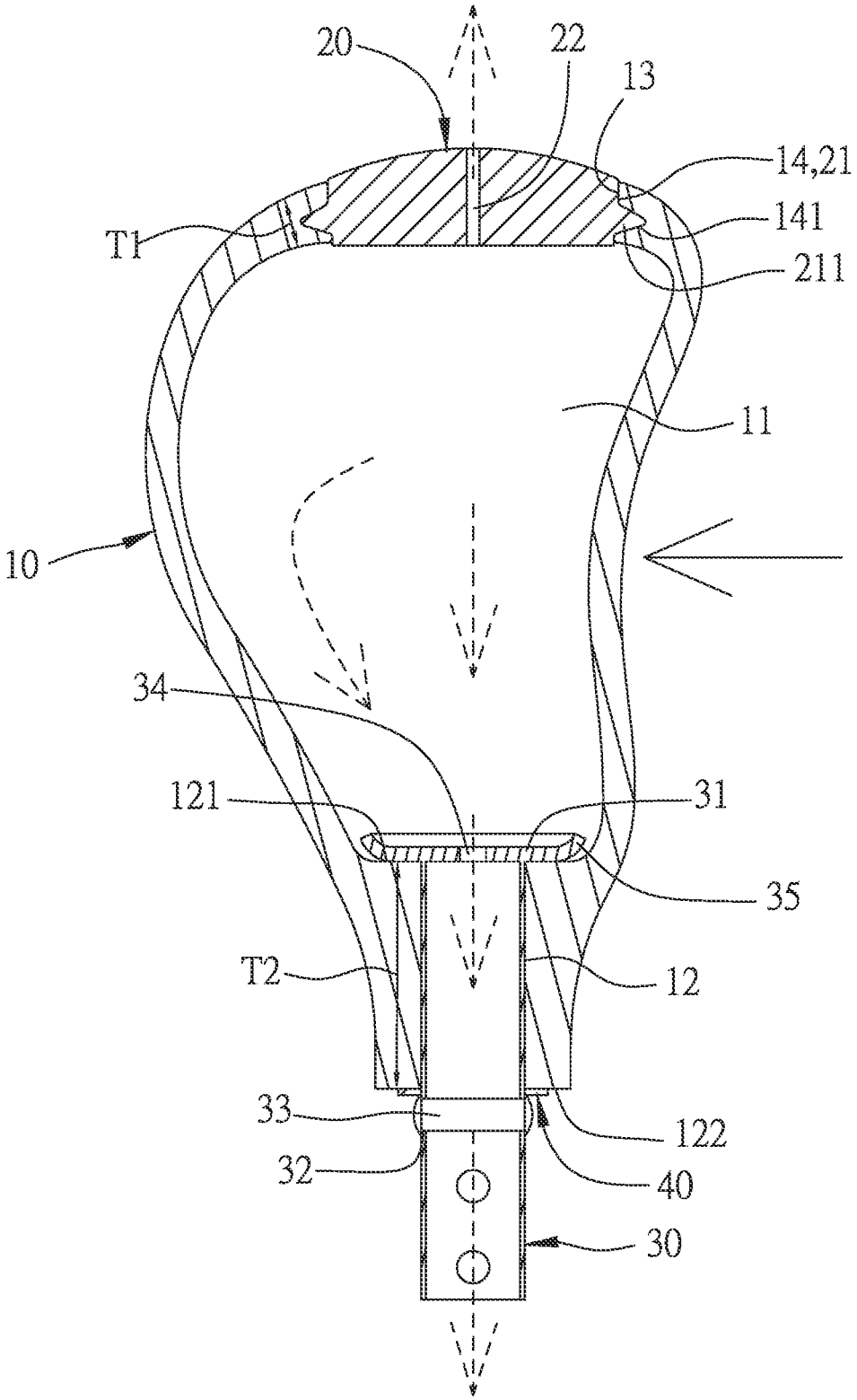
FIG. 4 is a schematic view showing the striking action of this disclosure.
Figure 5:
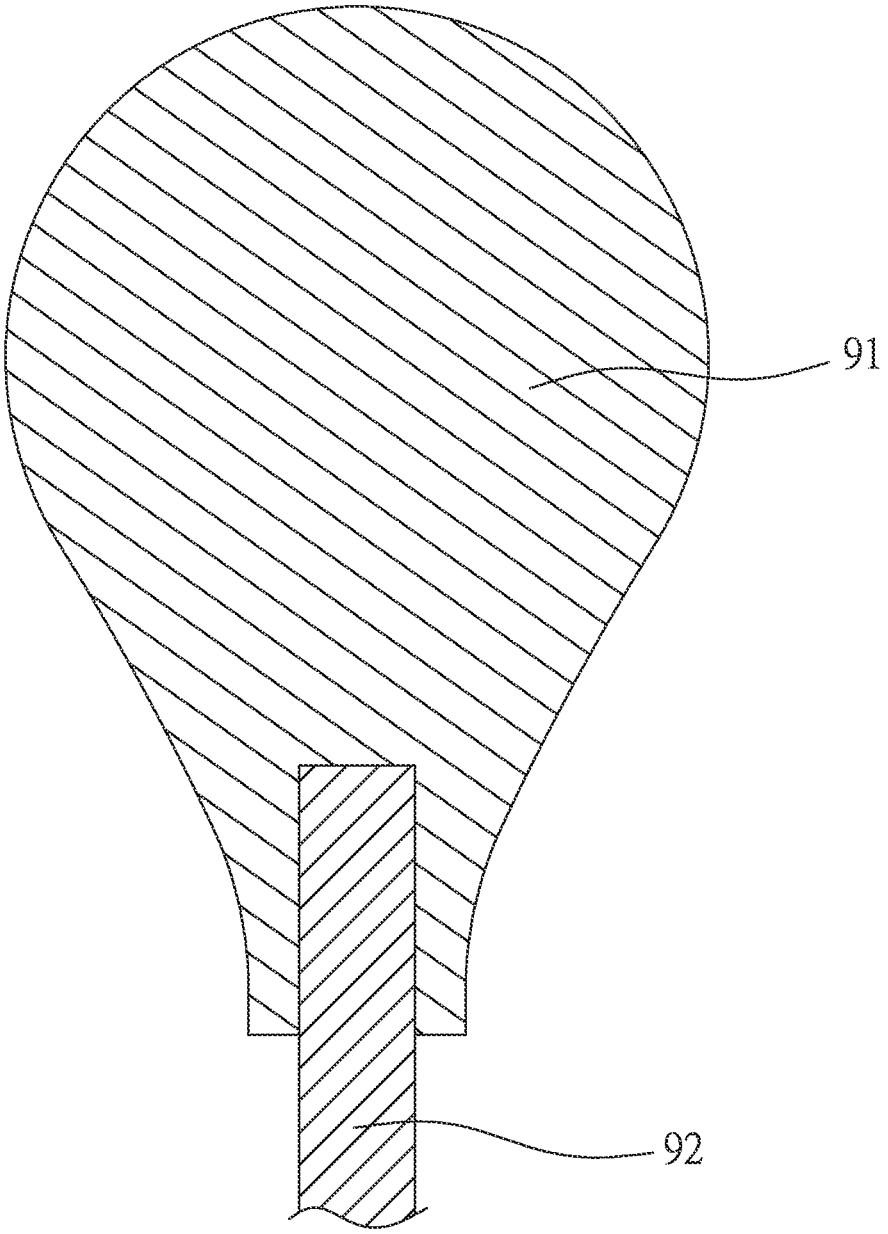
FIG. 5 PRIOR ART
FIG. 5 is a cross-sectional view of a conventional striking practice device.

During use as shown in FIG. 4, the striking body 10 is installed at a position with an appropriate height, and provided for a user to practice martial arts, kicking and boxing, and related sports. When the striking body 10 is hit, the striking body 10 will be elastically deformed, while the air in the hollow portion 11 of the striking body 10 will be compressed to discharge to the outside from the second air hole 34, so as to produce a better elastic deformation capacity.

The cover 20 of this embodiment has a first air hole 22 communicated with the hollow portion 11 of the striking body 10, so that when the striking body 10 is hit, air is discharged to the outside from the first air hole 22 to produce a better elastic deformation capacity.

With the structure of the aforementioned embodiments, this disclosure has the following advantages:

The striking practice device of this disclosure has the striking body 10 in a hollow shape and the striking thickness T1, and includes the first and second air hole 22, 34 communicated with the hollow portion 11, and thus not just having good structural strength and durability only, but also having the advantages of long service life, good elastic deformation capacity, and low manufacturing cost.

While various embodiments in accordance with the present invention have been shown and described, it is clear to those skilled in the art that further embodiments may be made without departing from the scope of the present invention.

What is claimed is:

1. A striking practice device, comprising:

a striking body comprising:

a wall having an outer surface, an inner surface, and a striking distance therebetween, the inner surface defining a hollow portion of the striking body;

an assembly hole formed along a direction, the assembly hole having an inner junction in communication with the hollow portion and an outer junction at the outer surface, a clamping distance being defined between the inner junction and the outer junction, the clamping distance being greater than the striking distance; and a cover hole formed along another direction, the cover hole extending between the outer surface and the inner surface, the cover hole having an inner fitting portion between the outer surface and the inner surface;

a cover configured with a shape corresponding to a shape of the cover hole, the cover having an outer fitting portion disposed at an outer edge of the cover, the outer fitting portion configured to correspond to the inner fitting portion for sealing the cover hole, the cover having a first air hole communicating with the hollow portion of the striking body;

a connecting rod passed and installed into the assembly hole, the connecting rod having an inner fixing plate disposed at an end thereof, the inner fixing plate having a diameter greater than a diameter of the assembly hole, the inner fixing plate installed at the inner junction; and an outer fixing plate fixed to the connecting rod, wherein the connecting rod is in a hollow tubular shape, and the connecting rod comprises a second air hole communicating with the hollow portion of the striking body.

2. A striking practice device comprising:

a striking body comprising:

a wall having an outer surface, an inner surface, and a striking distance therebetween, the inner surface defining a hollow portion of the striking body;

an assembly hole formed along a direction, the assembly hole having an inner junction in communication with the hollow portion and an outer junction at the outer surface, a clamping distance being defined between the inner junction and the outer junction, the clamping distance being greater than the striking distance; and a cover hole formed along another direction, the cover hole extending between the outer surface and the inner surface, the cover hole having an inner fitting portion between the outer surface and the inner surface;

a cover configured with a shape corresponding to a shape of the cover hole, the cover having an outer fitting portion disposed at an outer edge of the cover, the outer fitting portion configured to correspond to the inner fitting portion for sealing the cover hole, the cover having a first air hole communicating with the hollow portion of the striking body;

a connecting rod passed and installed into the assembly hole, the connecting rod having a horizontal through hole and a horizontal fixing part, the connecting rod having an inner fixing plate disposed at an end thereof, the inner fixing plate having a diameter greater than a diameter of the assembly hole, the inner fixing plate installed at the inner junction; and an outer fixing plate fixed to the connecting rod by the horizontal through hole and the horizontal fixing part.

3. A striking practice device comprising:

a striking body comprising:

a wall having an outer surface, an inner surface, and a striking distance therebetween, the inner surface defining a hollow portion of the striking body;

an assembly hole formed along a direction, the assembly hole having an inner junction in communication with the hollow portion and an outer junction at the outer surface, a clamping distance being defined between the inner junction and the outer junction, the clamping distance being greater than the striking distance; and a cover hole formed along another direction, the cover hole extending between the outer surface and the inner surface, the cover hole having an inner fitting portion between the outer surface and the inner surface;

a cover configured with a shape corresponding to a shape of the cover hole, the cover having an outer fitting portion disposed at an outer edge of the cover, the outer fitting portion configured to correspond to the inner fitting portion for sealing the cover hole, the cover having a first air hole communicating with the hollow portion of the striking body;

a connecting rod passed and installed into the assembly hole, the connecting rod having an inner fixing plate disposed at an end thereof, the inner fixing plate having a diameter greater than a diameter of the assembly hole, the inner fixing plate installed at the inner junction; and an outer fixing plate fixed to the connecting rod, wherein an outer peripheral edge of the inner fixing plate defines an arc-shaped surface, the arc-shaped surface contacting the inner junction.

* * * * *